US005390784A

United States Patent [19]

Sutherland

[11] Patent Number: 5,390,784

[45] Date of Patent: Feb. 21, 1995

[54] WRAP-AROUND CARRIER WITH PARTIAL END PANELS

[75] Inventor: Robert L. Sutherland, Kennesaw, Ga.

[73] Assignee: Riverwood International Corporation, Atlanta, Ga.

[21] Appl. No.: 191,226

[22] Filed: Feb. 3, 1994

[51] Int. Cl.[6] ..... B75D 65/12

[52] U.S. Cl. ..... 206/148; 206/140; 206/434

[58] Field of Search ..... 229/40; 206/140, 147, 206/148, 161, 427, 434

[56] References Cited

U.S. PATENT DOCUMENTS

| | | | |
|---|---|---|---|
| 3,128,010 | 4/1964 | Forrer | 206/140 X |
| 3,181,727 | 5/1965 | Graser et al. | 229/40 X |
| 3,270,914 | 9/1966 | Graser | 206/140 |
| 3,294,280 | 12/1966 | Graser | 229/40 X |
| 3,398,856 | 8/1968 | Graser | 206/148 X |
| 4,437,606 | 3/1984 | Graser | 229/40 |
| 4,597,523 | 7/1986 | Schuster | 229/40 |
| 4,901,849 | 2/1990 | Wilson | 206/148 |
| 4,925,019 | 5/1990 | Ganz et al. | 229/40 X |

*Primary Examiner*—Byron P. Gehman

[57] ABSTRACT

A wrap-around carrier including partial end panels for covering the pricing code on the end articles in the package. The partial end panels are comprised of flaps connected to the side panels and to the end tuck flaps of a set of three triangularly shaped tuck flaps. The three tuck flaps interact with the end articles in the carrier to act as a locking mechanism which holds the end panel flaps in place.

7 Claims, 4 Drawing Sheets

WRAP-AROUND CARRIER WITH PARTIAL END PANELS

FIELD OF THE INVENTION

This invention relates to wrap-around article carriers. More particularly, it relates to wrap-around carriers which include partial end panels capable of blocking the price code printed on the end articles.

BACKGROUND OF THE INVENTION

Certain types of articles, such as food or beverage containers, are commonly sold either as individual units or in a multi-container carton. Each article is normally marked with a pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred instead to provide wrap-around carriers with partial end panels of a size sufficient to cover the pricing code on the end articles in the package. Such a design would require less stock than a fully enclosed carrier and be correspondingly more economical to produce. Partial end panels designed to cover pricing codes located near the bottom of the article require only a short panel extending up from the bottom panel. To cover pricing codes located more centrally or even higher on the articles a different approach is necessary. It would be preferable in those cases to provide a partial end panel extending down from the top panel. The requirements of such a design is that the partial end panels be minimal in size, not interfere with the normal fabrication and packaging methods of wrap-around carriers, and be locked in place after being formed.

Wrap-around carriers have in the past been formed with partial end panels for purposes other than to cover the pricing code on individual end articles in the package, such as providing a more finished appearance to the package, providing more surface for printing and protecting the labels on bottles or other articles against damage. The partial end panel designs of such carriers have not been found to be suitable for the shape of current bottle designs and so improved designs have been sought. It is therefore an object of the invention to provide an improved partial end panel design having all the desirable features mentioned above.

BRIEF DESCRIPTION OF THE INVENTION

The invention comprises a wrap-around carrier having partial end panels formed of end panel flaps foldably connected to the end edges of the side panels. Each end panel flap has an upper edge foldably connected to an end tuck flap, and each end tuck flap is foldably connected to a central tuck flap. The central tuck flap is foldably connected to the adjacent end edge of the top panel and underlies the top panel between the end articles in the carrier. The central tuck flap is spaced from the upper edge of the adjacent end panel flaps.

Each end tuck flap has an edge contacting the neck portion of an adjacent article, which holds the connected central tuck flap in place. These edges are formed by cutouts separating portions of the end tuck flaps from the central tuck flap. This arrangement in turn holds the end panel flaps in place, which are of sufficient size to cover the pricing code on the end articles. The top panel may include bottle neck openings, and short sloped panels, also with bottle neck openings, may be connected to the top panel to enable the carrier to conform more closely to the shape of the articles.

Preferably, the fold lines connecting each side panel to the end panel flaps are angled toward each other so that the distance between the lower ends of these fold lines is less than the distance between their upper ends. This arrangement facilitates the overlapping of the end panel flaps.

The carrier is economical to manufacture and simple to wrap around the articles to be packaged. By locking the end panels in place by mechanical means, covering of the pricing code on the end articles is ensured.

The above and other aspects and benefits of the invention will readily be apparent from the more detailed description of the preferred embodiment of the invention which follows.

DETAILED DESCRIPTION OF THE PREFERRED EMBODIMENT

Figure 1:
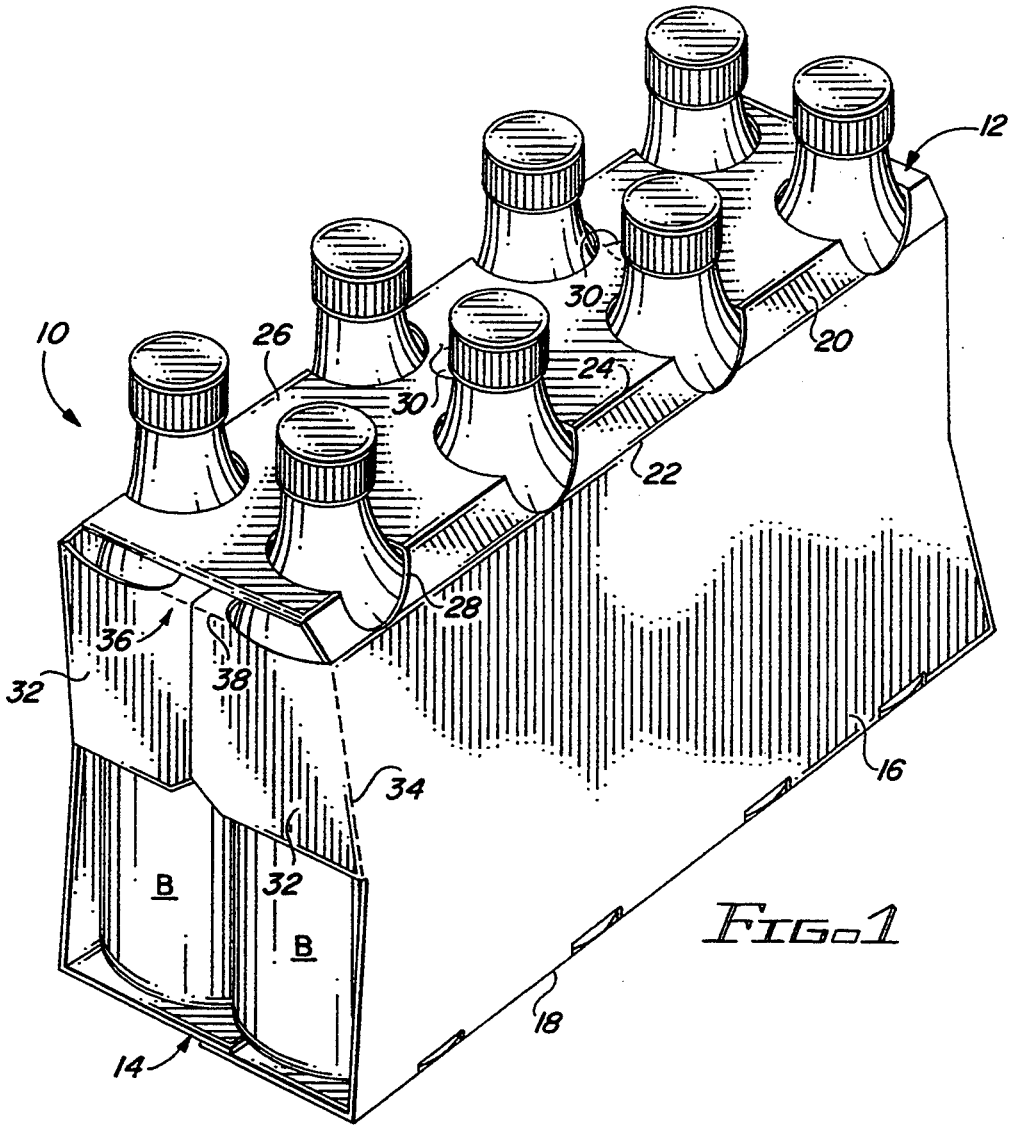
FIG. 1 is a pictorial view of the wrap-around carrier of the invention illustrated as part of a package containing eight beverage bottles.

Referring to FIG. 1, a package 10 is comprised of a wrap-around carrier 12 containing eight abutting beverage bottles B supported on bottom panel 14. Side panels 16 are connected to the bottom panel along fold line 18 and to a short sloped panel 20 along fold line 22. The sloped panels 20, which permit the upper portions of the side panels to more closely conform to the shape of the bottles, are connected by fold lines 24 to top panel 26. Included in the top panel are bottle neck openings 28, through which the necks of the bottles protrude, and finger holes 30. In addition, the carrier includes partial end panels comprised of overlapping end panel flaps 32 connected to the side panels along fold lines 34. The end panel flaps 32 are connected to locking structure 36 along fold lines 38 which, as explained in more detail below, maintains the end flaps in place.

Figure 2:
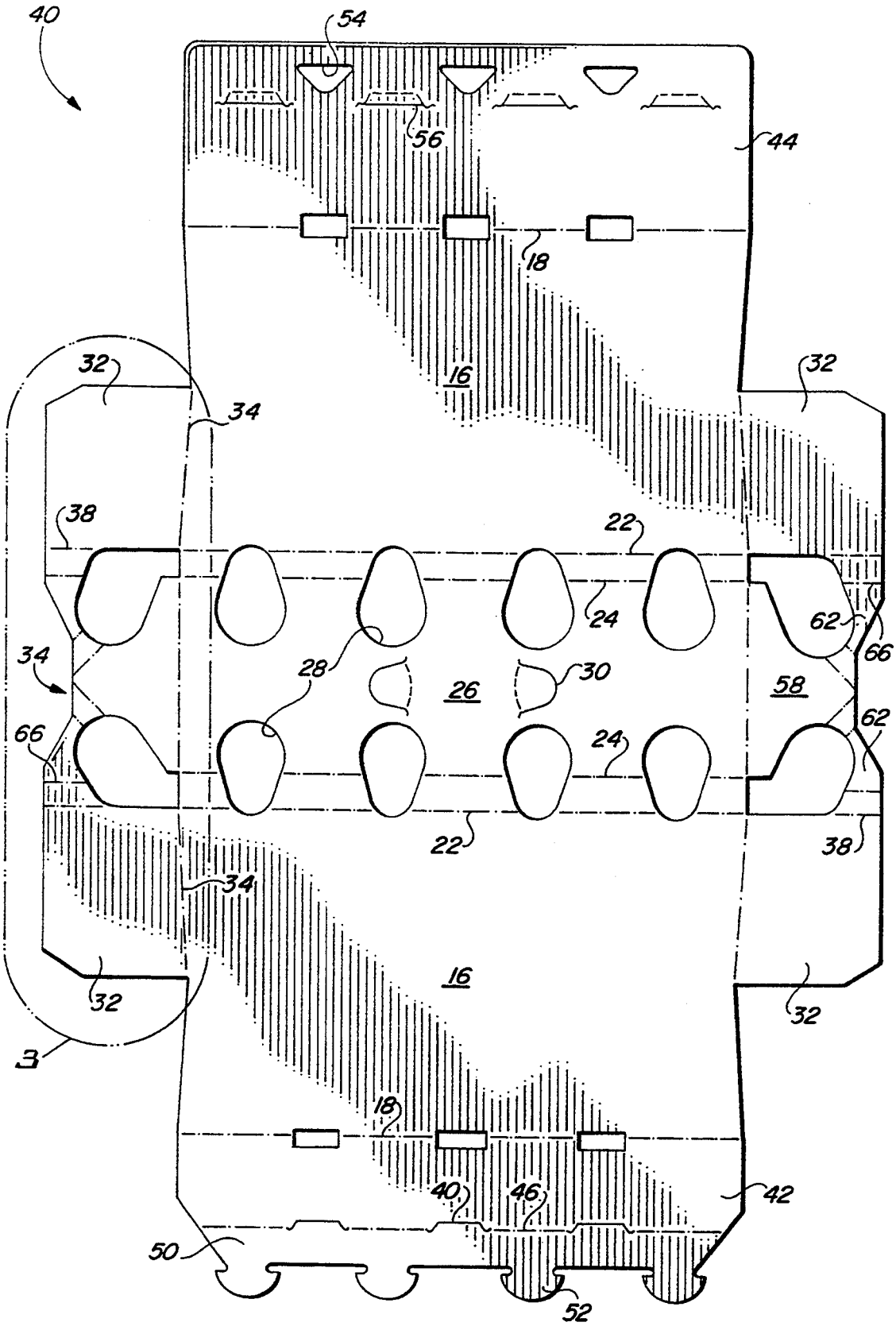
FIG. 2 is a plan view of a blank for forming the carrier of FIG. 1.

Referring to FIG. 2, wherein like reference numerals to those used in FIG. 1 denote like elements, a blank 40 capable of being fabricated into the carrier of FIG. 1 includes a centrally located top panel section 26, adjacent short panel sections 20 and side panel sections 16 adjacent to the short panel sections 20. Connected to the side panel sections at the fold lines 18 at opposite ends of the blank are bottom panel flaps 42 and 44. The bottom panel flap 42 includes a fold line 46 which extends the full length of the flap and which is interrupted by primary male locking tabs 48. The portion 50 of the flap 42 lying outwardly of the fold line 46 constitutes a locking panel which includes secondary male locking tabs 52. The bottom panel flap 44 includes primary female locking edges 54 adapted to engage the primary male locking members 48 and slits 56 adapted to receive the secondary locking tabs 52. Although these various locking elements are illustrated to demonstrate a typical bottom panel locking arrangement suitable for use with the carrier of the invention, it should be understood that any desired effective form of bottom panel locking means may be employed.

Figure 3:
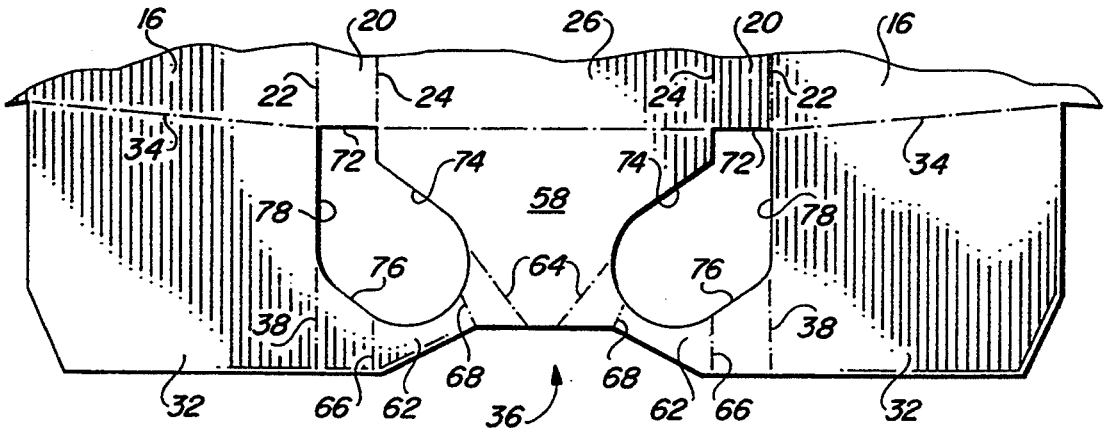
FIG. 3 is an enlarged plan view of the portion of the blank within the oval 3 of FIG. 2.

As shown in both FIGS. 1 and 2, the end panel flaps 32 are connected to the upper end portion of the side panel sections 16 by fold lines 34, which intersect with the ends of fold lines 22. Preferably, as made more clear below, the width of each side panel at its connection to the short sloped panel portion, that is, along the length of fold line 22, is greater than the width of the side panel as measured between the lower ends of the end flap fold lines 34. The locking means 36, a portion of which is visible in FIG. 1, is shown in FIGS. 2 and 3 to be comprised of a generally triangular central tuck flap 58 connected to the top panel along fold line 60 and two generally triangular end tuck flaps 62, each of which is connected to its adjacent end panel flap by fold line 38 and to the central tuck flap by fold line 64. A score line 66 in each end tuck flap is spaced from and substantially parallel to the fold line 38. Another score line 68 in each end tuck flap is spaced from, and angled slightly toward, the fold line 64. In addition, cutouts 70 are provided in the end flap locking structure. Each cutout is shaped so that a portion 72 of its circumference comprises the edge of the short sloped panel 20, a portion 74 comprises part of the adjacent side edge of the central tuck flap 58, a portion 76 comprises the inner edge of the associated end tuck flap 62 and a portion 78 comprises the upper edge of the associated end panel flap 32. The cutout edge portions 74 and 76 are arcuate for reasons explained below.

Figure 4:
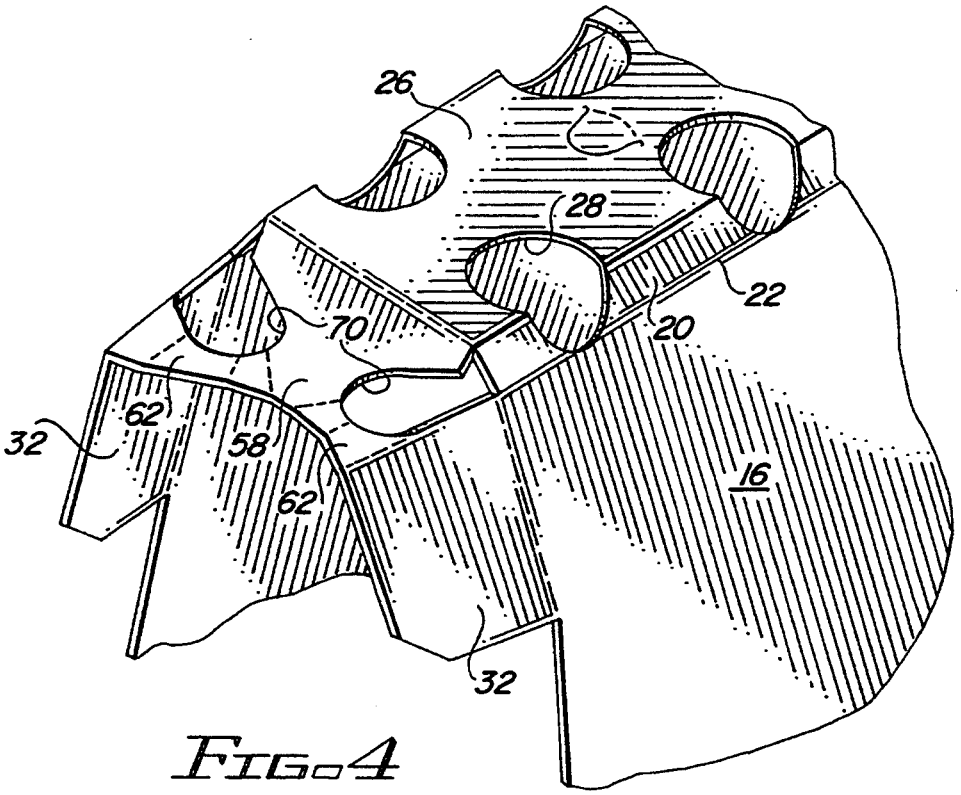
FIG. 4 is a partial pictorial view of the carrier blank in an early phase of the formation of a carrier, showing the blank after the side panels and tuck flaps have been initially folded.

To form a package of articles, the blank is lowered onto a group of eight bottles so that the bottle necks extend up through the openings 28 in the top panel section. Of course the number of bottles to be packaged may vary, with the dimensions of the carrier and the number of bottle neck openings being correspondingly modified. At the same time that the side panel sections 16 of the blank are folded down about the fold lines 22 and 24, the central tuck flap 58 is pushed in toward the bottles. This pulls the end tuck flaps 62 with it, which in turn pull in the end panel flaps 32, causing the central and end tuck flaps to pivot up about the fold lines 64 and the end tuck flaps and end panel flaps to pivot down about the fold lines 38. FIG. 4 illustrates the blank at a representative point in this initial folding process.

Figure 5:
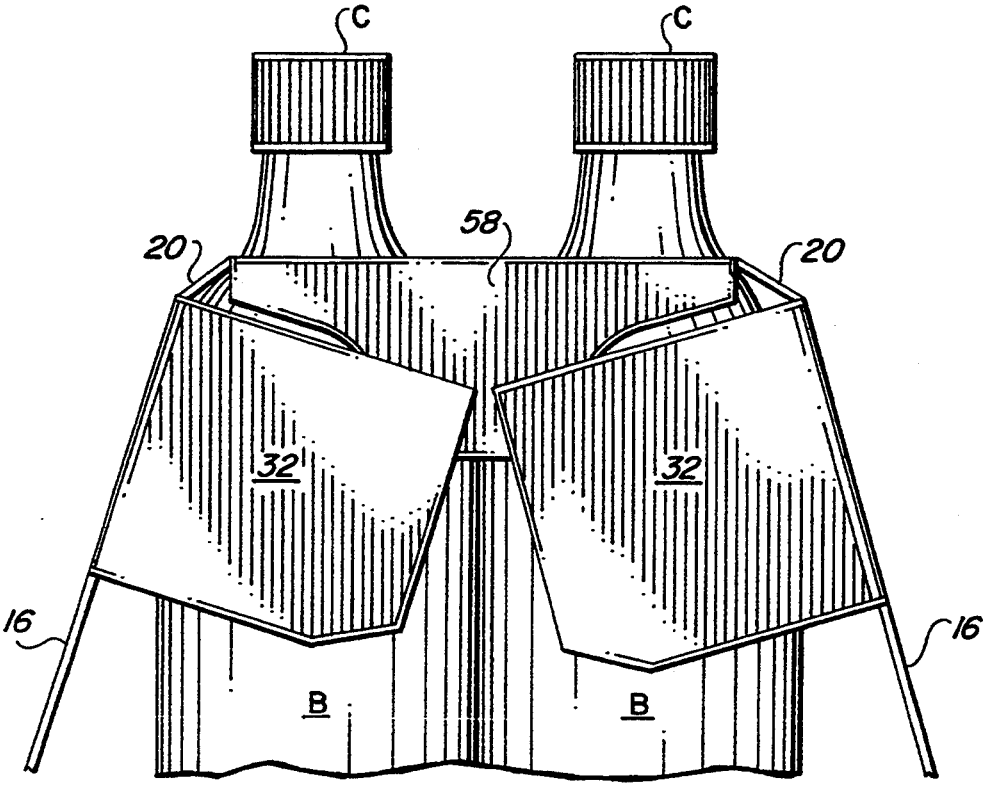
FIG. 5 is an end view of the carrier during a later phase of its formation.

As seen best in FIGS. 1 and 2, it is preferred that the upper edges of the side panels 16 form an angle with the fold line 22 which is slightly less than a right angle. When the end panel flaps 32 are folded in toward each other about their fold lines 38 as a result of the folding actions described above, this slight angle causes the inner upper corners of the end panel flaps to reach each other before the lower portions of the end panel flaps. This is illustrated in FIG. 5. The end tuck flaps are not visible in this view because they are hidden behind the end panel flaps. The inner side edges of the two end panel flaps then progressively reach each other as the folding operation continues to completion. This arrangement prevents the inner side edges of the end panel flaps from reaching each other at the same time and possibly binding, which would interfere with the overlapping of the flaps. It is desirable for the end panel flaps to overlap since it precludes any spaces or gaps between the flaps, thereby ensuring that the pricing code on individual articles is completely covered.

Figure 6:
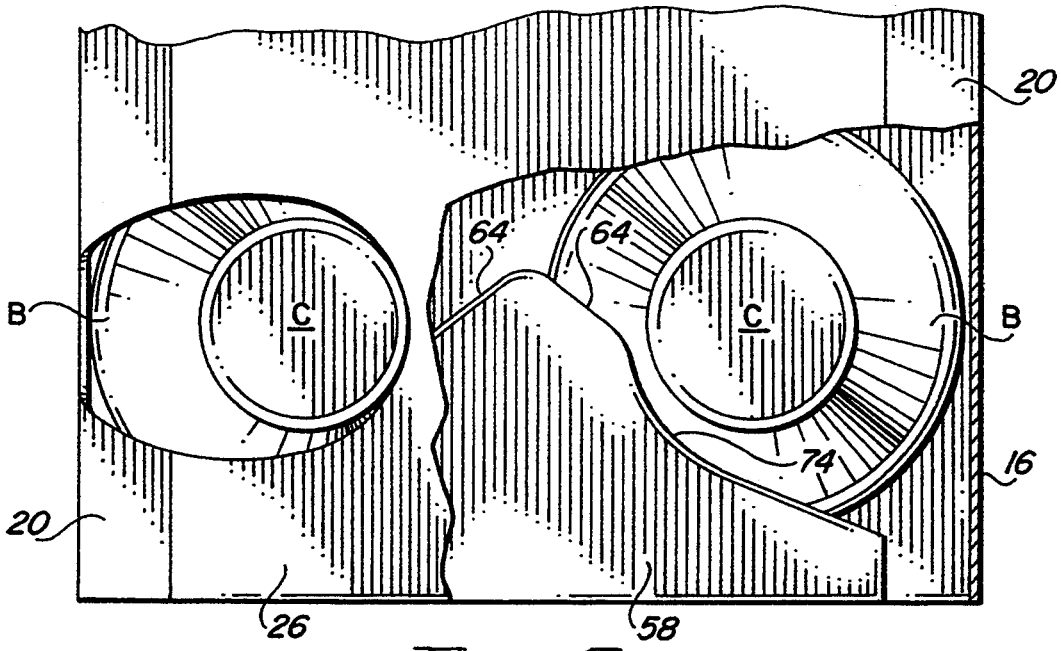
FIG. 6 is an enlarged partial plan view of the carrier, with a portion of the top panel removed to show the final position of the central tuck flap.

As the central tuck flap 58 is folded in toward the bottles, the arcuate cutout edges 74 of the central tuck flap follow the contour of the adjacent bottles. Although these edges may actually contact the bottles, it is preferred that they fall slightly short of contacting them so as not to risk interfering with the movement of the central tuck flap. The final position of the central tuck flap 58, and in particular its edges 74 and the fold lines 64 with respect to a bottle B and the bottle cap C, is illustrated in FIG. 6, wherein the top panel 26 has been removed from one of the overlying bottle areas to reveal the central tuck flap. It will be understood that the end tuck flaps are hidden in this view by the central tuck flap.

Figure 7:
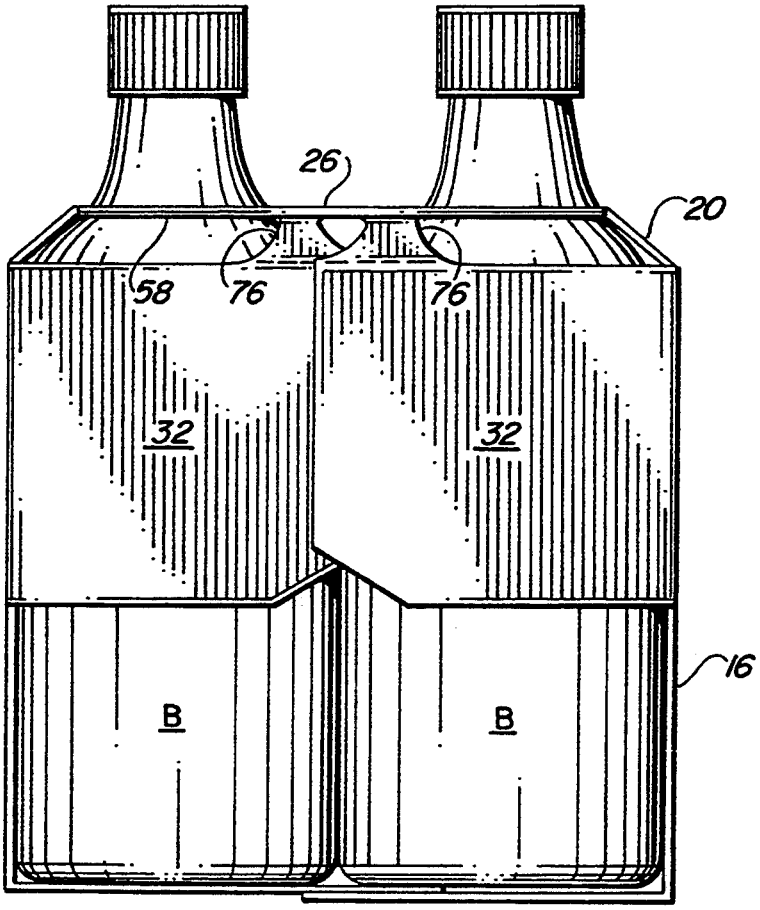
FIG. 7 is an end view of the carrier of FIG. 1.

During the folding process the curved cutout edges 76 of the end tuck flaps slide along the bottle necks, again not interfering with the folding of the central tuck flap, until the central tuck flap is folded up against the underside of the top panel. At least portions of the edges 76 of the end tuck flaps engage and are supported by the bottle neck, causing the central tuck flap to be held in its fully folded condition. In this final locking position, which is best illustrated in FIGS. 1 and 7, the end tuck flaps 62 extend in from the top edge of the end panel flaps 32 and are folded down from the central tuck flap along score line 64. Note that the upper edge of the end panel flaps in the final package is spaced from the top panel by an amount dependent upon the width and slope of the short sloped panel 20. Any additional flexing of the end tuck flaps required by the difference in height between the score lines 38 and 64 of the end tuck flaps is assisted by the intermediate score lines 66 and 68.

Although these folding steps can be done by hand it is contemplated that they would be carried out in a packaging machine as the bottles and blank are continuously moving through the machine. In order to facilitate the folding of the tuck flaps it may be desirable to initially maintain the two rows of bottles in a slightly spaced relationship. This eliminates any possibility of the flaps binding against the bottles as they are moved into position. The bottles would be brought into abutting relationship prior to or at the time of formation of the bottom panel.

After the end panel forming procedures described above are completed the bottom panel is formed by folding in the bottom panel flaps and locking them together. The details of the locking phase of the operation have not been illustrated since the particular locking mechanism employed does not form part of the invention. It will be understood by those familiar with the locking elements shown, however, that the outer flap portion or locking panel 50 of the bottom panel flap 42 is folded back about the fold line 46 and the primary male locking tabs 48 are engaged with the primary female locking edges 54 in bottom panel flap 44. The secondary male locking tabs 52 are then inserted through the slits 56 to complete the mechanical locking action.

Spacing of the end panel flaps from the top panel is not dependent on the inclusion of a short sloped panel. If the shape of the packaged articles does not require the provision of a short sloped panel the end panel flaps may be spaced from the top panel by spacing them from the fold line connecting the top panel to the side panel.

As to the height of the end panel flaps, it may vary but should be sufficient for the flaps to extend down far enough to cover the pricing code on the articles.

It should now be apparent that the invention provides a means for covering the price code of end articles in a wrap-around carrier by automatically locking partial end panel flaps in place when the end panels are formed. It will be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A package comprised of a wrap-around carrier containing two rows of adjacent articles, the carrier having opposite end portions adjacent end articles in the rows, each article having a neck portion connected to a main body portion, comprising:

opposite side panels connected to a top panel and to a bottom panel, each side panel including a short outwardly sloped portion extending downwardly from the top panel;

the side and top panels including opposite end edges adjacent the end portions of the carrier;

an end panel flap connected to each end edge of each side panel along a first fold line located below the short outwardly sloped portion of the associated side panel;

each end panel flap having an upper edge connected to a respective end tuck flap along a second fold line;

each end tuck flap being connected to a respective central tuck flap disposed at each end portion of the carrier, along a respective third fold line, each end tuck flap being connected to the remainder of the carrier only along said respective second and third fold lines and being unconnected to the short outwardly sloped portions;

each central tuck flap being connected to a respective adjacent end edge of the top panel along a fourth fold line, each central tuck flap underlying the top panel between two adjacent end articles and being spaced from the upper edge of adjacent end panel flaps;

each end tuck flap having an end tuck flap edge contacting the neck portion of an adjacent one of said articles, said end tuck flap edge comprising an edge portion of a cutout, the cutout also being comprised of edge portions of the associated central tuck flap and a portion of the upper edge of the adjacent end panel flap located between the associated end tuck flap and the associated side panel; and the end panel flaps at each end of the carrier covering portions of adjacent ones of said articles.

2. A package as defined in claim 1, wherein each short outwardly sloped side panel portion has a lower end intersecting a respective said first fold line at the upper end of the first fold line.

3. A package as defined in claim 1, wherein the end panel flaps at each of the carrier overlap each other and the first fold lines at each end edge of a side panel are angled toward each other so that the distance between the lower ends of said fold lines is less than the distance between the upper ends thereof.

4. A package as defined in claim 1, wherein the edge portions of the central tuck flaps are adjacent a portion of the periphery of the neck portion of an adjacent one of said articles.

5. A package as defined in claim 1, wherein the end tuck flaps contain score lines permitting flexing of said end tuck flaps.

6. A package as defined in claim 1, wherein the end articles contain pricing codes on the sides thereof and the end panel flaps cover the portions of the articles containing the pricing codes.

7. A blank for forming a wrap-around carrier for containing two rows of adjacent articles of the type having a neck portion connected to a main body portion, comprising:

a centrally located top panel section, two short side panel sections and two long side panel sections, each short side panel section being located between and being connected to the top panel section and a long side panel section;

each long side panel section being connected to a bottom panel flap, the long side panel sections and the top panel section including end edges which are located at the ends of a carrier formed from the blank;

a respective end panel flap connected to each end edge of each long side panel section along a respective first fold line;

each end panel flap having a flap edge connected to a respective end tuck flap along a second fold line, said flap edge being an upper edge in a carrier formed from the blank;

each end tuck flap being connected to a central tuck flap along a third fold line, each end tuck flap being connected to the remainder of the blank only along said second and third fold lines and;

each central tuck flap being connected to a respective adjacent end edge of top panel section along a fourth fold line, the central tuck flaps, when folded about the fourth fold lines, underlying the top panel section in a carrier formed from the blank and being spaced from the upper edges of adjacent end panel flaps;

each end tuck flap having an end tuck flap edge adapted to contact the neck portion of an adjacent article in a carrier formed from the blank, said end tuck flap edge comprising an end edge portion of a cutout, the cutout also having edge portions which include edge portions of the associated central tuck flap and a portion of the upper edge of the adjacent end panel flap.

* * * * *